US007159958B1

(12) United States Patent
Lu

(10) Patent No.: US 7,159,958 B1
(45) Date of Patent: Jan. 9, 2007

(54) SLIDING RAIL ASSEMBLY AUTO LOCKING STRUCTURE FOR DRAWER

(76) Inventor: Chun-Min Lu, 1F., No.12, Alley 12, Lane 151, Sha-Lun Rd., Tamshui Chen, Taipei Hsien (TW)

( * ) Notice: Subject to any disclaimer, the term of this patent is extended or adjusted under 35 U.S.C. 154(b) by 267 days.

(21) Appl. No.: 10/863,221

(22) Filed: Jun. 9, 2004

(51) Int. Cl.
*A47B 88/00* (2006.01)

(52) U.S. Cl. ..... 312/334.44; 312/333

(58) Field of Classification Search ..... 312/334.44, 312/334.46, 334.47, 333, 334.1, 334.7, 334.8, 312/334.9, 334.11, 319.1; 384/21, 22
See application file for complete search history.

(56) References Cited

U.S. PATENT DOCUMENTS

| | | | | |
|---|---|---|---|---|
| 6,652,050 | B1 * | 11/2003 | Lin | 312/333 |
| 6,733,097 | B1 * | 5/2004 | Kim et al. | 312/333 |
| 6,799,817 | B1 * | 10/2004 | Chu | 312/333 |
| 6,979,066 | B1 * | 12/2005 | Yang | 312/333 |
| 6,997,528 | B1 * | 2/2006 | Yang | 312/333 |
| 2004/0000850 | A1 * | 1/2004 | Ham et al. | 312/333 |
| 2004/0239218 | A1 * | 12/2004 | Jurja | 312/333 |

FOREIGN PATENT DOCUMENTS

| | | | |
|---|---|---|---|
| DE | 297 01 895 | * | 3/1997 |
| DE | 196 45 628 | * | 6/1997 |

* cited by examiner

*Primary Examiner*—Janet M. Wilkens
(74) *Attorney, Agent, or Firm*—Troxell Law Office, PLLC

(57) ABSTRACT

A sliding rail assembly auto locking structure includes a holder base affixed to the outer rail of a sliding rail assembly, the holder base having two longitudinal sliding slots and two locating holes respectively downwardly extended from the front end of the longitudinal sliding slots, a movable hook slidably mounted in the longitudinal sliding slots and biasable when the front guide rod thereof entered the locating holes, a spring member connected between the holder base and the movable hook, and a locating block affixed to the inner sliding rail of the sliding rail assembly and forced into engagement with the movable hook to turn the movable hook out of the locating holes and to move with the movable hook to the back side upon return stroke of the inner sliding rail with the drawer, the locating block forcing the movable hook into the locating holes and moving away from the movable hook upon forward stroke of the inner sliding rail with the drawer.

4 Claims, 9 Drawing Sheets

SLIDING RAIL ASSEMBLY AUTO LOCKING STRUCTURE FOR DRAWER

BACKGROUND AND SUMMARY OF THE INVENTION

The present invention relates to a sliding rail assembly for drawer and more specifically, to an auto locking structure used in a sliding rail assembly for drawer, which is easy to assembly with less labor and time consumption and, which achieves locking action positively.

FIGS. 1 and 2 illustrate a sliding rail assembly auto locking structure used in a sliding rail assembly 8 for drawer. This sliding rail assembly auto locking structure comprises a holder base 81, a link 82, and a movable block 83. This design of sliding rail assembly auto locking structure is complicated, resulting in high manufacturing cost and high installation difficulty. Further, the movable block 83 may be biased accidentally during installation or use, thereby causing the locating block 841 of the inner sliding rail 84 unable to push the movable block 83. In this case, the inner sliding rail 84 cannot be returned to the received position.

FIG. 3 shows another design of sliding rail assembly auto locking structure used in a sliding rail assembly 9 for drawer. According to this design, the sliding rail assembly auto locking structure comprises a holder base 91, a spring member 92, a link 93, and a push block 941 at the inner sliding rail 94. This design of sliding rail assembly auto locking structure is still not satisfactory in function. Because the spring member 92 has the two ends thereof turned at right angles after installation, the spring member 92 wears quickly with use and tends to deform permanently. Further, because the spring member 92 is exposed to the outside of the sliding rail assembly, it may be forced out of the sliding rail assembly accidentally.

Therefore, it is desirable to provide a sliding rail assembly auto locking structure that eliminates the aforesaid drawbacks.

The present invention has been accomplished under the circumstances in view. It is therefore the main object of the present invention to provide a sliding rail assembly auto locking structure, which is inexpensive to manufacture and easy to install. According to one aspect of the present invention, thee sliding rail assembly auto locking structure is comprised of a locating block, a movable hook, a spring member, and a holder base. The simple structure design is inexpensive to manufacture and easy to install. According to another aspect of the present invention, the movable hook has frond and rear guide rods by which the movable hook can be moved forwards/backwards along two parallel longitudinal sliding slots in a longitudinal sliding track of the holder base smoothly. When pulling the drawer from the received position to the extended position, the front guide rod of the movable hook will be forced into locating holes of the holder base to disengage the movable hook from a locating block at the inner sliding rail, for enabling the inner sliding rail to be moved with the drawer to the extended position. When pushing the drawer backwards from the extended position to the received position, the locating rod of the locating block at the inner sliding rail will be moved over a sloping front guide face into a locating groove at the movable hook and forced against the back wall of the locating groove to bias the movable hook, enabling the spring member to pull the movable hook backwards to the rear end of the longitudinal sliding slots. According to still another aspect of the present invention, the holder base comprises a protruding wall projecting into the rear part of the bottom open side of the longitudinal sliding track to shield the spring member, keeping the spring member in place. According to still another aspect of the present invention, the holder base comprises two guide grooves bilaterally formed in the longitudinal siding track and respectively extended from the front end of the longitudinal sliding slots to the topmost edge of the longitudinal sliding track for easy insertion of the guide rods of the movable hook into the longitudinal sliding slots of the longitudinal siding track during installation. According to still another aspect of the present invention, the spring member is linearly stretchable for durable use.

DETAILED DESCRIPTION OF THE INVENTION

Figure 1:
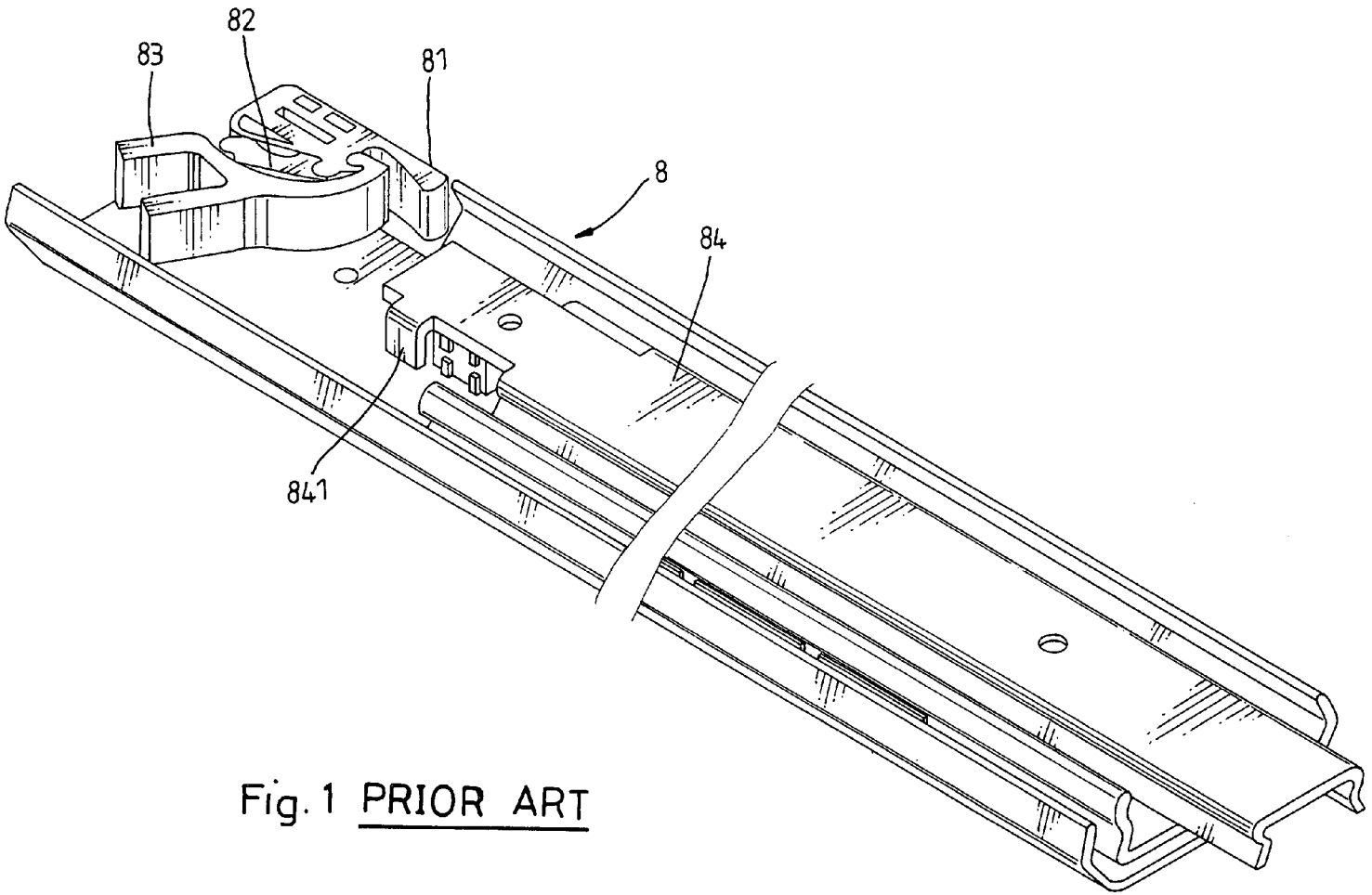
Fig. 1 PRIOR ART
FIG. 1 is a perspective view showing a failure of a sliding rail assembly auto locking structure according to the prior art.
Figure 2:
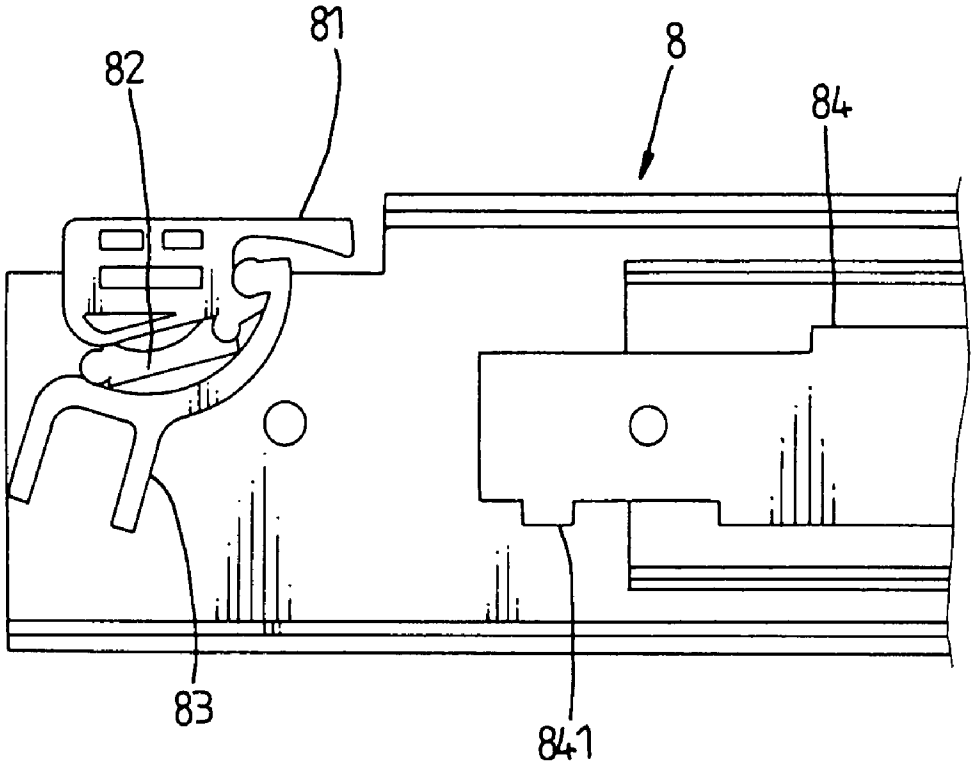
Fig. 2 PRIOR ART
FIG. 2 is a top plain view of a part of FIG. 1.
Figure 3:
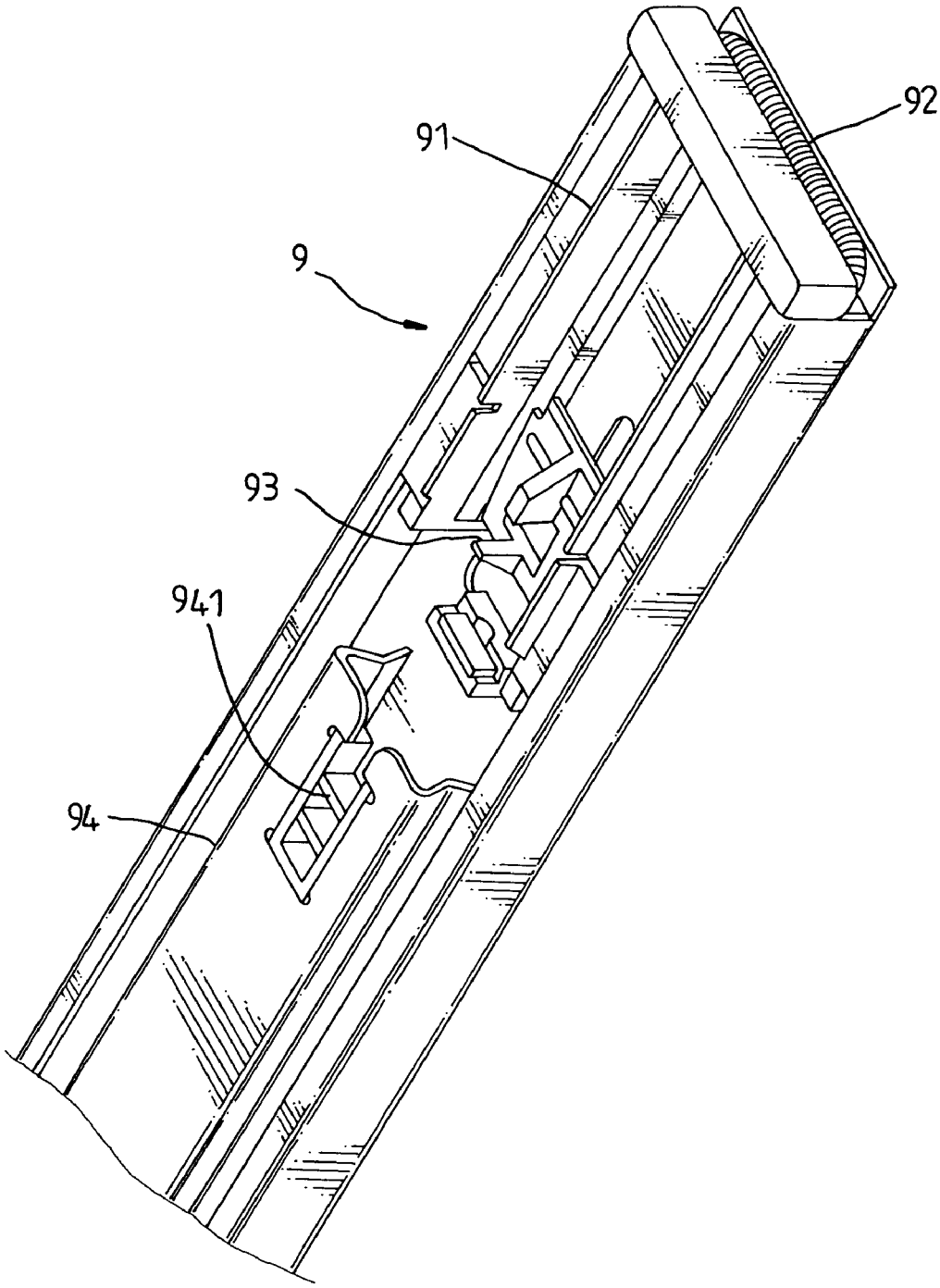
Fig. 3 PRIOR ART
FIG. 3 is a perspective view of another structure of sliding rail assembly auto locking structure according to the prior art.
Figure 4:
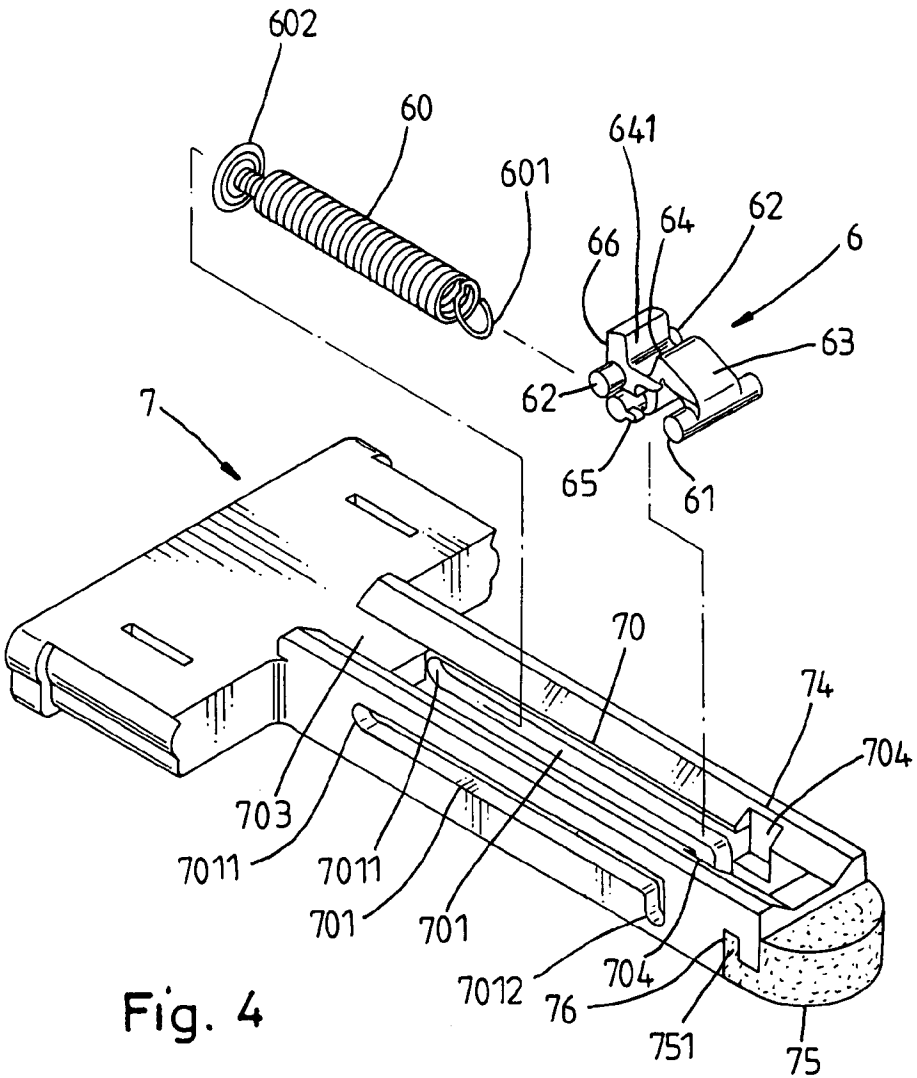
FIG. 4 is an exploded view of a sliding rail assembly auto locking structure according to the present invention (the locating block excluded).
Figure 5:
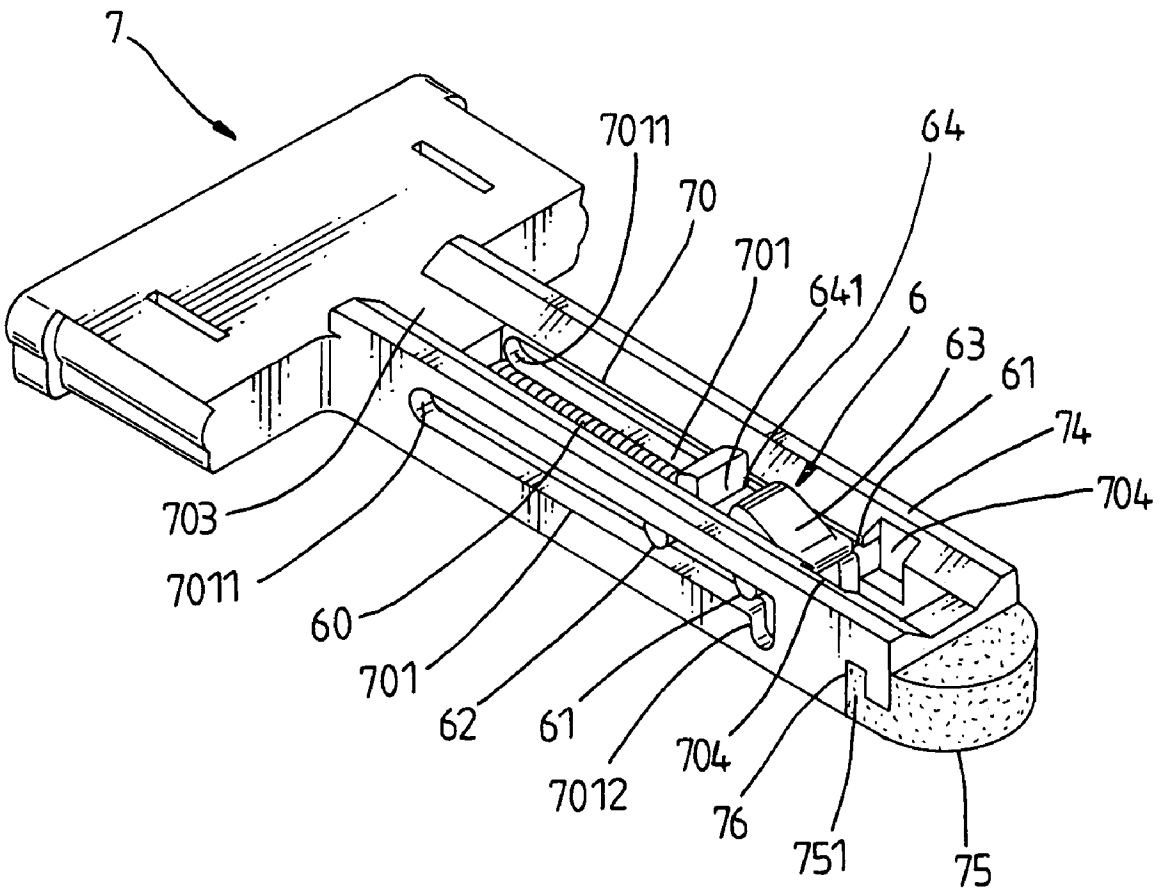
FIG. 5 is a perspective assembly view of FIG. 4.
Figure 6:
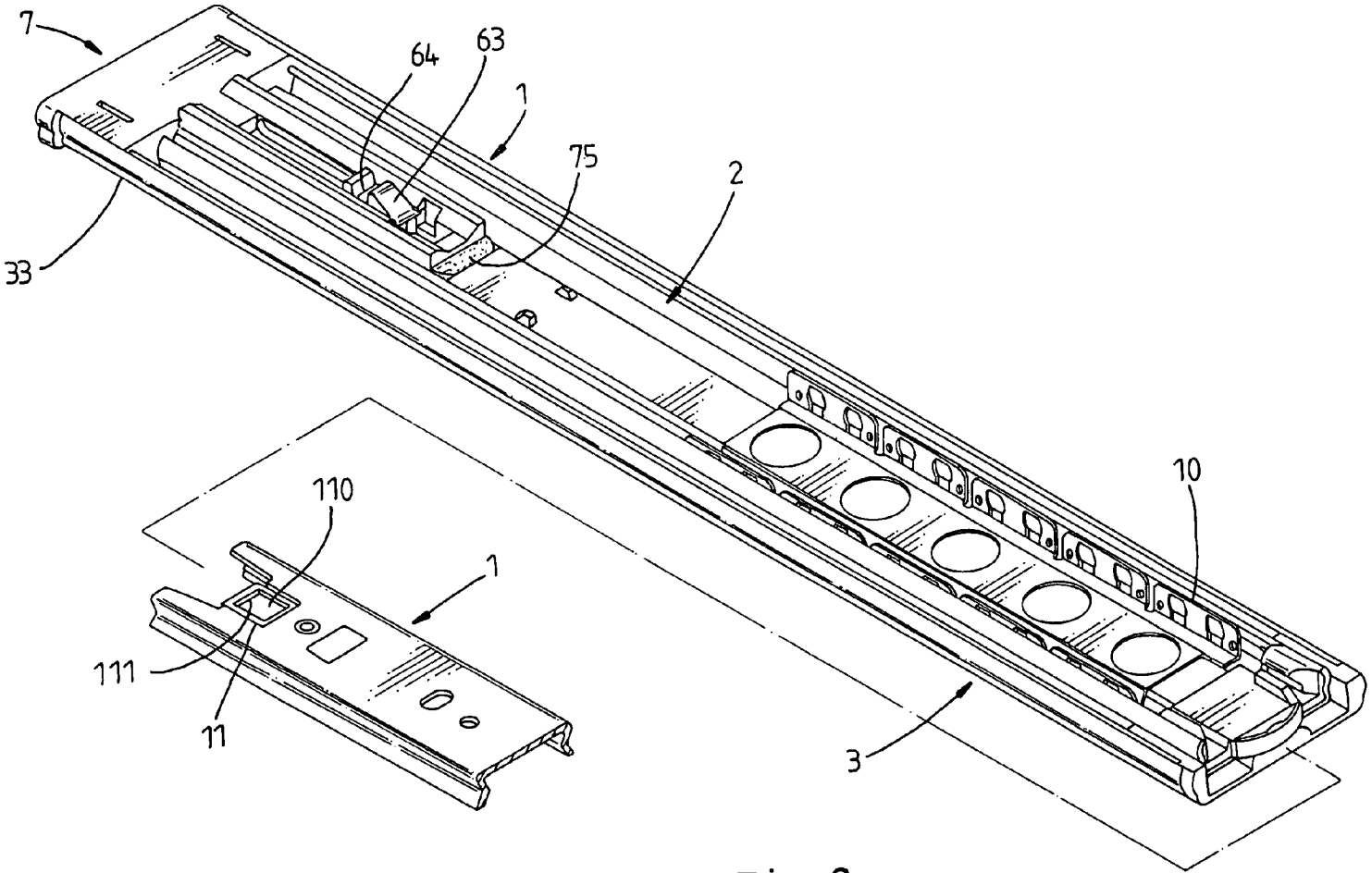
FIG. 6 shows the sliding rail assembly auto locking structure installed in a sliding rail assembly before positioning of the inner sliding rail in the intermediate sliding rail according to the present invention.
Figure 7:
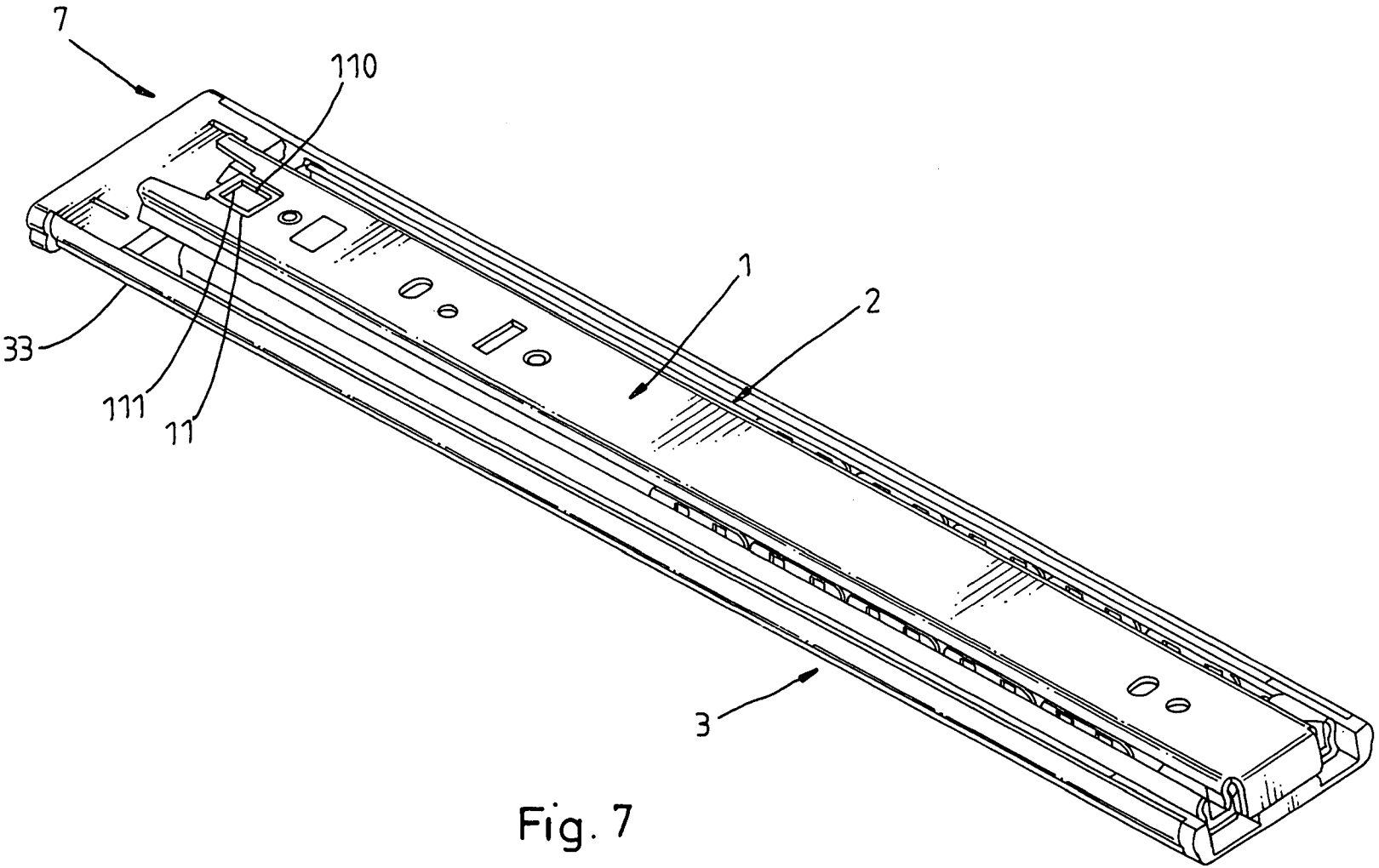
FIG. 7 is an assembly view of FIG. 6.
Figure 8:
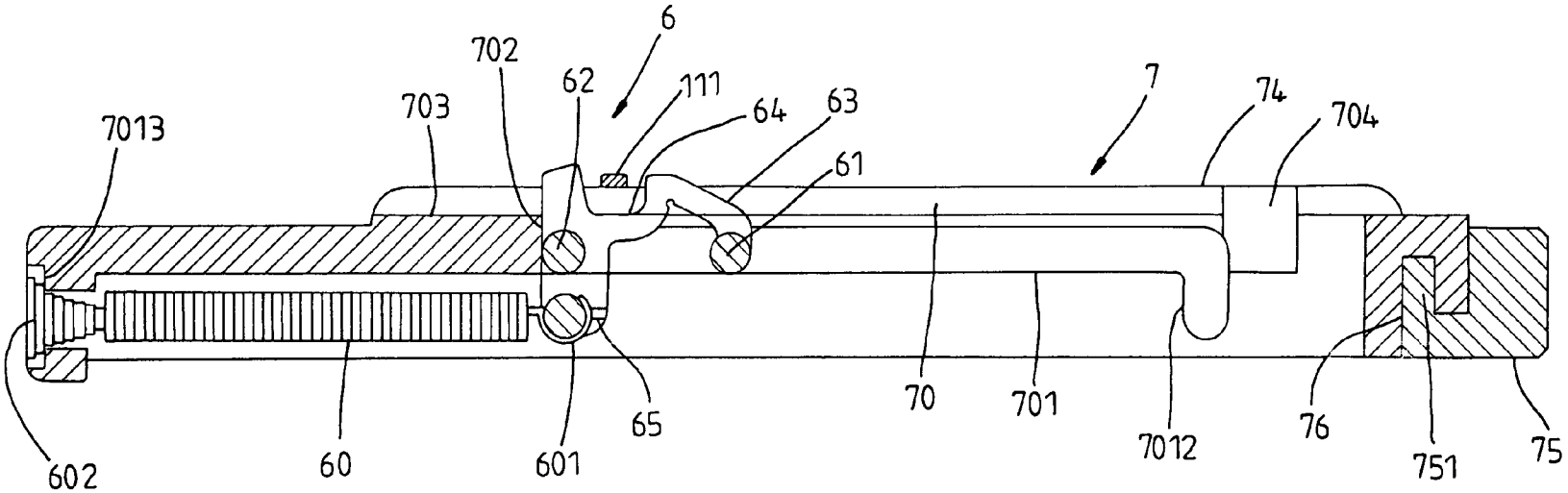
FIG. 8 is a sectional view of the present invention showing the movable block stopped at the rear end of the longitudinal sliding slots.
Figure 9:
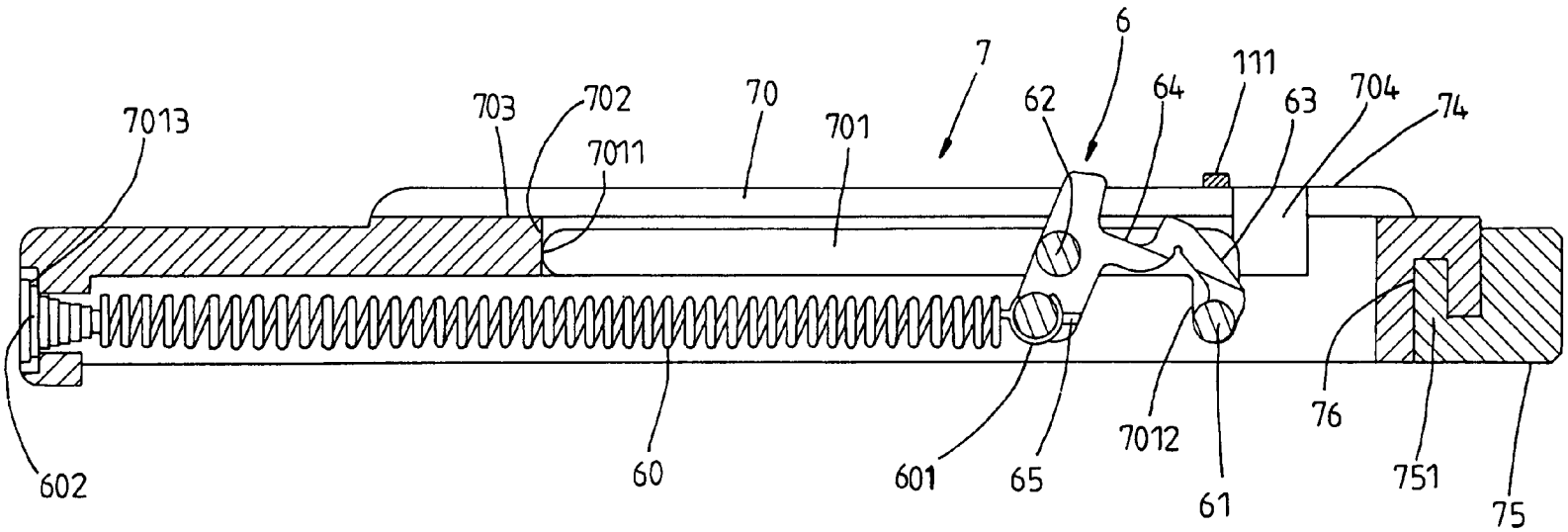
FIG. 9 is similar to FIG. 8 but showing the movable block moved to the front side and biased, the front guide rod forced into the locating holes.

Referring to FIGS. 4~9, a sliding rail assembly auto locking structure is used in a sliding rail assembly for drawer. According to the present preferred embodiment, the sliding rail assembly comprises an outer rail 3, an intermediate sliding rail 2 axially movably mounted in the outer rail 3, an inner sliding rail 1 axially movably mounted in the intermediate sliding rail 2, a first bushing 10 set between the inner sliding rail 1 and the intermediate sliding rail 2, and a second bushing (not shown) set between the intermediate sliding rail 2 and the outer rail 3. The outer rail 3 is fixedly mounted on the inside wall of a desk (not shown) at a suitable location. The inner sliding rail 1 has the top side thereof affixed to one side panel of a drawer (not shown) receivable in the desk. By means of the sliding rail assembly, the drawer is movable in and out of the desk.

The sliding rail assembly auto locking structure comprises a locating block 11 fixedly provided at a rear end of the inner sliding rail 1, the locating block 11 having an opening 110 and a transverse locating rod 111 at the front side of the opening 110, a holder base 7 fixedly fastened to the bottom wall 33 of the outer rail 3 at the rear side, a movable hook 6 coupled to the holder base 7, and a spring member 60 coupled between the movable hook 6 and the holder base 7. Upon backward movement of the inner sliding rail 1 with the drawer, the transverse locating rod 111 pushes the movable hook 6, for enabling the spring member 60 to pull the movable hook 6 and the inner sliding rail 1 to the back side, achieving the designed auto locking effect.

The main features of the present invention are outlined hereinafter. The holder base 7 comprises a longitudinal sliding track 70, two longitudinal sliding slots 701 symmetrically formed in the longitudinal sliding track 70 at two opposite lateral sides, two locating holes 7012 respectively downwardly extended from the front end of the longitudinal sliding slots 701 (see FIGS. 8 and 9), a locating device 7013 at the rear side, and a stop face 702 adjacent to the rear end 7011 of the longitudinal sliding slots 701.

The movable hook 6 comprises a front guide rod 61 and a rear guide rod 62 coupling to the longitudinal sliding slots 701 of the holder base 7 to guide forward/backward movement of the movable hook 6 along the longitudinal sliding track 70, a sloping front guide face 63, a locating groove 64 transversely formed in the top side on the middle, a rear stop face 66 at the rear side, and a locating device 65 situated at the bottom of the rear stop face 66.

The spring member 60 has a front end 601 fastened to the locating device 65 of the movable hook 6, and a rear end 602 fastened to the locating device 7013 of the holder base 7.

When the sliding rail assembly is in the received position, the rear guide rod 62 and rear stop face 66 of the movable hook 6 are respectively stopped at the rear ends 7011 of the longitudinal sliding slots 701 of the longitudinal sliding track 70 and the stop face 702 of the holder base 7 (see FIG. 8); and the transverse locating rod 111 of the locating block 11 is set in the locating groove 64 of the movable hook 6 to lock the movable hook 6 to the inner sliding rail 1. When pulling the inner sliding rail 1 outwards at this time, the movable hook 6 is carried by the locating block 11 to move forwards with the inner sliding rail 1 along the longitudinal sliding slots 701 of the holder base 7. When the front guide rod 61 reached the front ends of the longitudinal sliding slots 701 during forward movement of the movable hook 6 with the inner sliding rail 1, the front guide rod 61 is forced downwards into the locating holes 7012 of the longitudinal sliding slots 701 (see FIG. 9), and therefore the movable hook 6 is disengaged from the locating rod 111 of the locating block 11, allowing further forward movement of the inner sliding rail 1. On the contrary, when pushing the inner sliding rail 1 backwards from the extended position to the received position, the locating rod 111 of the locating block 11 is moved over the sloping front guide face 63 into the locating groove 64 of the movable hook 6 and forced against the back wall 641 of the locating groove 64 to bias the movable hook 6, thereby causing the front guide rod 61 to move upwards from the locating holes 7012 into the longitudinal sliding slots 701. At this time, the spring member 60 immediately pulls the movable hook 6 backwards to the rear end 7011 of the longitudinal sliding slots 701.

Further, the bottom side of the longitudinal sliding track 10 is an open side. The holder base 7 further comprises a protruding wall 703 projecting into the rear part of the bottom open side of the longitudinal sliding track 10 to shield the spring member 60, keeping the spring member 60 in place, and two guide grooves 704 bilaterally formed in the longitudinal siding track 70 and respectively extended from the front end of the longitudinal sliding slots 701 to the topmost edge of the longitudinal sliding track 70 for easy insertion of the guide rods 61, 62 of the movable hook 6 into the longitudinal sliding slots 701 of the longitudinal siding track 70 during installation.

The holder base 7 further comprises a front mounting hole 76 in the front end of the longitudinal siding track 70 for receiving a cushion block 75. The cushion block 75 is a polyurethane block having a rear mounting portion 751 press-fitted into the front mounting hole 76 of the holder base 7.

As indicated above, the sliding rail assembly auto locking structure has the following advantages:

1. The sliding rail assembly auto locking structure is comprised of a locating block 11, a movable hook 6, a spring member 60, and a holder base 7. The simple structure design is inexpensive to manufacture and easy to install.
2. By means of the guide rods 61, 62, the movable hook 6 can be moved forwards/backwards along the longitudinal sliding slots 601 smoothly. When pulling the drawer from the received position to the extended position, the front guide rod 61 will be forced into the locating holes 7012 to disengage the movable hook 6 from the locating block 11, for enabling the inner sliding rail 1 to be moved with the drawer to the extended position. When pushing the drawer backwards from the extended position to the received position, the locating rod 111 of the locating block 11 will be moved over the sloping front guide face 63 into the locating groove 64 of the movable hook 6 and forced against the back wall 641 of the locating groove 64 to bias the movable hook 6, enabling the spring member 60 to pull the movable hook 6 backwards to the rear end 7011 of the longitudinal sliding slots 701.
3. The holder base 7 comprises a protruding wall 703 projecting into the rear part of the bottom open side of the longitudinal sliding track 10 to shield the spring member 60, keeping the spring member 60 in place.
4. The holder base 7 comprises two guide grooves 704 bilaterally formed in the longitudinal siding track 70 and respectively extended from the front end of the longitudinal sliding slots 701 to the topmost edge of the longitudinal sliding track 70 for easy insertion of the guide rods 61, 62 of the movable hook 6 into the longitudinal sliding slots 701 of the longitudinal siding track 70 during installation.
5. The spring member 60 is linearly stretchable for durable use.

What is claimed is:

1. A sliding rail assembly auto locking structure used in a sliding rail assembly for a desk, said sliding rail assembly comprising an outer rail fixedly mountable on the inside wall of the desk, an intermediate sliding rail axially movably mounted in said outer rail, an inner sliding rail axially movably mounted in said intermediate sliding rail and affixable to one side panel of a drawer receivable in said desk, a first bushing set between said inner sliding rail and said intermediate sliding rail, and a second bushing set between said intermediate sliding rail and said outer rail, said sliding rail assembly auto locking structure comprising a locating block fixedly provided at a rear end thereof and affixable to said one side panel of the drawer of the desk receivable in the desk inner sliding rail, said locating block having an opening and a transverse locating rod at a front side of said opening, a holder base fixedly fastened to a bottom wall of said outer rail at a rear side, a movable hook coupled to said holder base, and a spring member coupled between said movable hook and said holder base;

wherein: said holder base comprises a longitudinal sliding track, two longitudinal sliding slots symmetrically formed in two opposite lateral sides of said longitudinal sliding track, said longitudinal sliding slots each having a rear end and a front end, two locating holes respectively downwardly extended from the front end of said longitudinal sliding slots, a locating device at a rear side, and a stop face adjacent to the rear end of said longitudinal sliding slots;

said movable hook comprises a front guide rod and a rear guide rod coupling inserted into the longitudinal sliding slots of said holder base to guide forward/backward movement of said movable hook along said longitudinal sliding track, a sloping front guide face, a locating groove transversely formed in a top side thereof on the middle for receiving said locating rod of said locating block, a rear stop face at a rear side thereof for stopping against the stop face of said holder base, and a locating device situated at a bottom side of said rear stop face;

said spring member has a front end fastened to the locking device of said movable hook and a rear end fastened to the locating device of said holder base.

2. The sliding rail assembly auto locking structure as claimed in claim 1, wherein said longitudinal sliding track has an open bottom side; said holder base comprises a protruding wall forwardly projecting into a rear part of the bottom open side of said longitudinal sliding track to shield said spring member and to keep said spring member in place.

3. The sliding rail assembly auto locking structure as claimed in claim 1, wherein said holder base comprises two guide grooves bilaterally formed in said longitudinal siding track and respectively extended from the front end of said longitudinal sliding slots to the topmost edge of said longitudinal sliding track.

4. The sliding rail assembly auto locking structure as claimed in claim 1, wherein said holder base comprises a front cushion block fixedly fastened to a front side of said longitudinal sliding track.

* * * * *